US011149683B2

(12) United States Patent
Hay-Heddle et al.

(10) Patent No.: US 11,149,683 B2
(45) Date of Patent: Oct. 19, 2021

(54) INTERNAL COMBUSTION ENGINE

(71) Applicant: ENHANCED ENERGY EFFICIENCY ENTERPRISES LIMITED, Nottinghamshire (GB)

(72) Inventors: John Hay-Heddle, Nottinghamshire (GB); Elliot Powick, West Midlands (GB)

(73) Assignee: ENHANCED ENERGY EFFICIENCY ENTERPRISES LIMITED, Nottinghamshire (GB)

( * ) Notice: Subject to any disclaimer, the term of this patent is extended or adjusted under 35 U.S.C. 154(b) by 7 days.

(21) Appl. No.: 16/494,122

(22) PCT Filed: Mar. 13, 2018

(86) PCT No.: PCT/GB2018/050632
§ 371 (c)(1),
(2) Date: Sep. 13, 2019

(87) PCT Pub. No.: WO2018/167474
PCT Pub. Date: Sep. 20, 2018

(65) Prior Publication Data

US 2020/0132017 A1 Apr. 30, 2020

(30) Foreign Application Priority Data

Mar. 13, 2017 (GB) ..... 1703998
Dec. 11, 2017 (GB) ..... 1720629

(51) Int. Cl.
*F02B 75/06* (2006.01)
*F02B 75/32* (2006.01)
(Continued)

(52) U.S. Cl.
CPC ..... *F02F 7/0019* (2013.01); *F02B 75/065* (2013.01); *F02B 75/32* (2013.01);
(Continued)

(58) Field of Classification Search
CPC ..... F02F 7/0019; F02B 75/32; F02B 3/06; F02B 41/04; F02B 2075/025;
(Continued)

(56) References Cited

U.S. PATENT DOCUMENTS 5,285,752 A * 2/1994 Reed ..... F02B 75/065 123/61 R
5,769,610 A 6/1998 Paul et al.
(Continued)

FOREIGN PATENT DOCUMENTS

BE 423799 A 10/1937
DE 3710706 A1 10/1988
(Continued)

OTHER PUBLICATIONS

International Search Report and Written Opinion dated Jul. 24, 2018 in connection with corresponding International Application No. PCT/US2018/050632.

*Primary Examiner* — Jacob M Amick
(74) *Attorney, Agent, or Firm* — Stout, Uxa & Buyan, LLP; Donald E. Stout

(57) ABSTRACT

A compression ignition internal combustion engine (1), which includes a cylinder (2), a piston (3) reciprocably received within the cylinder (2), a pair of contra-rotating crankshafts (4, 5) rotatably mounted relative to the cylinder (2), a pair of connecting rods (6, 7) each having a first end (61, 71) connected to a crank journal (41, 51) of a respective one of the crankshafts (4, 5) and a second end (62, 72) connected to the piston (3). The engine (1) is configured such that the stroke of the piston (3) in a first direction toward the crankshafts (4, 5) causes each crankshaft (4, 5) to rotate by a first angle and the piston stroke in a second
(Continued)

direction opposite the first direction causes each crankshaft (4,5) to rotate by a second angle different (β−α) from the first angle.

20 Claims, 8 Drawing Sheets

(51) Int. Cl.

| | |
|---|---|
| ***F02B 41/04*** | (2006.01) |
| ***F01B 9/02*** | (2006.01) |
| ***F02F 7/00*** | (2006.01) |
| *F02B 3/06* | (2006.01) |
| *F02B 75/02* | (2006.01) |

(52) U.S. Cl.
CPC . *F01B 9/02* (2013.01); *F02B 3/06* (2013.01); *F02B 41/04* (2013.01); *F02B 2075/025* (2013.01); *F02B 2075/027* (2013.01)

(58) Field of Classification Search
CPC .. F02B 2075/027; F02B 75/06; F02B 75/065; F02B 75/225; F01B 9/02
See application file for complete search history.

(56) References Cited

U.S. PATENT DOCUMENTS

| | | | | |
|---|---|---|---|---|
| 5,836,273 | A | 11/1998 | Hair | |
| 6,209,496 | B1 * | 4/2001 | Pelz | F02B 75/065 123/197.3 |
| 2010/0263621 | A1 * | 10/2010 | Swienink | F02B 75/065 123/197.4 |
| 2012/0055443 | A1 * | 3/2012 | Betzmeir | F02B 75/065 123/197.4 |
| 2017/0096934 | A1 * | 4/2017 | Tang | F02B 75/32 |

FOREIGN PATENT DOCUMENTS

| | | | |
|---|---|---|---|
| DE | 102008011959 | A1 | 9/2009 |
| GB | 15045 | A | 8/1896 |
| GB | 2320058 | A | 6/1998 |
| JP | 10220547 | A | 8/1998 |
| RU | 2089739 | | 9/1997 |
| WO | 9615355 | A1 | 5/1996 |
| WO | 2015172692 | A1 | 5/2015 |

* cited by examiner

INTERNAL COMBUSTION ENGINE

This invention relates generally to internal combustion engines. More specifically, although not exclusively, this invention relates to internal combustion engines having a twin crank arrangement.

Internal combustion engines are well known and are commonly used as a main, auxiliary or backup power source in vehicles, equipment and other portable or fixed machinery. Conventional internal combustion engines include a piston reciprocably received within a piston cylinder. The piston cylinder has inlet and exhaust valves at one end thereof for injecting and exhausting gas and fuel to and from the piston cylinder respectively. Typically, a single connecting rod connects a respective piston to a single crankshaft at a position which is offset from the axis of rotation of the crankshaft, thereby converting the reciprocating motion of the piston along the piston cylinder into rotational motion of the crankshaft. The crankshaft is coupled to a load, for example the drivetrain of a vehicle, which draws power from its rotational motion.

It has been observed that, as the degree of angularity between the piston and connecting rod increases, the forces exerted between them results in the piston bearing against the cylinder wall. This 'side thrust' generates friction and can reduce engine efficiency significantly. This effect is most pronounced in compression ignition engines where the pressure within the piston cylinder and acting upon the piston is greatest.

There has been much research in the field of internal combustion engines, particularly with the aim of increasing engine efficiency. One approach that has been proposed involves the use of two crankshafts, a so-called 'twin crank' arrangement. The aim of this design is to counter the disadvantages of the aforementioned side thrust. Such twin crank proposals include a pair of crankshafts each positioned on a respective side of the piston centerline. A pair of connecting rods are provided, each of which is connected at one of its ends to a respective one of the crankshafts and to a common piston at its other end.

It has been proposed that the use of a twin crank arrangement can reduce the side thrust on the piston and the resulting friction losses. U.S. Pat. No. 5,682,844, for example, proposes a motorcycle engine, with an offset between the axis of rotation of each of the respective crankshafts and the centerline of the piston. U.S. Pat. No. 229,788 discloses dual crankshaft engine with a combination of co-acting parts that allow the connecting rods, during the power stroke of the engine, to produce a total force greater than the force produced by the ignited fuel charge on the piston.

It is believed that, whilst the designs proposed to date may reduce the friction due to side thrust present in the conventional internal combustion engine, other harmful effects result from such arrangements, which have hitherto prevented their commercial implementation.

It is therefore a first non-exclusive object of the invention to provide a twin crank internal combustion engine that overcomes, or at least mitigates the issues with known designs. It is a more general, non-exclusive object of the invention to provide an improved twin crank internal combustion engine.

Accordingly, a first aspect of the invention provides an internal combustion engine, e.g. a compression ignition engine, comprising a cylinder, a piston reciprocably received within the cylinder, a pair of crankshafts, a pair of connecting rods each having a first end connected to a respective one of the crankshafts, e.g. pivotally connected such as by a crank journal thereof, and a second end connected to the piston, e.g. pivotally connected such as by a piston connector, wherein the engine is configured such that the piston stroke in a first direction e.g. toward the crankshafts, causes each crankshaft to rotate by a first angle and the piston stroke in a second direction e.g. opposite the first direction, causes each crankshaft to rotate by a second angle, e.g. different from the first angle.

The Applicant has observed that twin crank engines provide an asymmetric relationship between upward and downward strokes, which can be used to improve the efficiency of certain engine configurations. More particularly, when compared to conventional internal combustion engines, the output of work can be optimised by carefully selecting the offset between the axis of rotation of the crankshaft and the centerline of the piston. The asymmetry between the crankshaft rotation during the upward and downward strokes is transferred to the engine cycle such that the angular displacement of the crankshaft for the induction/power stroke differs from that of the compression/exhaust stroke.

It is believed that such asymmetry is particularly beneficial in compression ignition engines. In embodiments, the engine may be operable or configured to be powered using a diesel or biodiesel fuel or even jet fuel, aviation turbine fuel or any other suitable fuel. The engine may comprise a diesel or biodiesel engine.

It is also envisaged, however, that the internal combustion engine comprises a spark ignition engine. The engine may be operable or configured to be found using petrol, gasoline or any other suitable fuel, such as autogas (LPG), methanol, ethanol, bioethanol, compressed natural gas (CNG), hydrogen or nitromethane. The engine may comprise a petrol or gasoline engine.

In embodiments, the internal combustion engine may comprise a gas expansion engine e.g. a steam engine.

As used herein, the term 'offset' refers to a distance in a direction perpendicular to the central axis of the cylinder and the piston which reciprocates therein. For example, the engine may comprise a crankshaft offset, which may be described by an offset between the axis of rotation of the or each crankshaft and the central axis, or a projected centerline, of the cylinder and/or piston. This offset corresponds to the distance in a direction perpendicular to the central axis or projected centerline.

Similarly, the engine may comprise a piston connection offset, which may be described by an offset between the or each piston connection and the central axis, or projected centerline, of the cylinder and/or piston. This offset also corresponds to the distance in a direction perpendicular to the central axis or projected centerline.

Furthermore, the engine may comprise an effective crankshaft offset, which may correspond to the difference between the crankshaft offset and the piston connection offset. Accordingly, an alternative definition of the effective crankshaft offset is that it is described by an offset between the axis of rotation of the or each crankshaft and the piston connector to which its connecting rod (i.e. the connecting rod connected thereto) is connected.

The crankshafts may be rotatably mounted, for example relative to the cylinder, and preferably rotate in opposite directions or contra-rotate. The crankshafts may comprise contra-rotating crankshafts. The crankshafts may rotate such that the connections between them and the connecting rods converge during the initial part of the stroke in the first direction and/or during the final part of the stroke in the second direction. The crankshafts may rotate such that the connections between them and the connecting rods diverge during the final part of the stroke in the first direction and/or during the initial part of the stroke in the second direction.

The second angle may be between 18 and 50 degrees less than the first angle, for example between 20 and 48 degrees, 24 and 44 degrees or 26 and 42 degrees less than the first angle. Preferably, the second angle is between 28 and 40 degrees, for example between 30 and 38 degrees less than the first angle. More preferably, the second angle is between 32 and 36 degrees less than the first angle, such as between 33 and 35 degrees or about 34 degrees less than the first angle.

The piston may be movable between a top dead centre position and a bottom dead centre position. The top and bottom dead centre positions of the piston may comprise piston top and bottom dead centre positions. The top dead centre position may correspond to a position where the piston is at an uppermost position or where the piston is at its furthest position from the crankshaft. The bottom dead centre position may correspond to a position where the piston is at a lowermost position or where the piston is at its nearest position to the crankshaft.

The first direction may comprise a downstroke or correspond to a movement away from piston top dead centre. The second direction may comprise an upstroke or correspond to movement away from piston bottom dead centre. The initial part of the stroke in the first direction may comprise movement from top dead centre and/or the initial part of the stroke in the second direction may comprise movement from bottom dead centre. The final part of the stroke in the first direction may comprise movement to bottom dead centre and/or the final part of the stroke in the second direction may comprise movement to top dead centre.

The first angle may be the angular rotation of the crankshaft which corresponds to the travel of the piston from its top dead centre position to its bottom dead centre position. The second angle may be the angular rotation of the crankshaft which corresponds to the travel of the piston from its bottom dead centre position to its top dead centre position.

At least one of the crankshafts may comprise a first position, which may comprise an uppermost, upper, home, zero degree, zero or crankshaft top dead centre position. At least one of the crankshafts may comprise a second position, which may comprise a lowermost, lower, 180 degree or crankshaft bottom dead centre position. The first position may comprise or correspond to a position or orientation of the crankshaft when a connection between the crankshaft and the connecting rod is at an uppermost, home, zero degree or zero position. The second position may comprise or correspond to a position or orientation of the crankshaft when the connection between the crankshaft and the connecting rod is at a lowermost or 180 degree position.

The first end of each connecting rod may be connected to a crank journal of a respective one of the crankshafts. The engine may comprise a crankshaft throw radius, which may be comprise or be described between, e.g. by a distance between, an axis of rotation of the or each crankshaft and its crank journal or connection with the connecting rod.

The engine may be configured such that the effective crankshaft offset is between 1.4 and 1.9 times the crankshaft throw radius. The engine may be configured such that the crankshaft offset is between 1.4 and 1.9 times the sum of the crankshaft throw radius and the piston connection offset. Alternatively, either of these ratios may be between 1.5 and 1.8 or between 1.6 and 1.7 or about 1.65.

Preferably, the side thrust component of any forces between the crankshaft and the piston is no more than the centerline or vertical component thereof. This may be achieved, for example, by ensuring that the connecting rod orientation relative to the centerline of the piston and cylinder does not exceed 45°.

The engine may comprise an effective connecting rod length described by the length of a straight line extending from the connection, or an axis thereof, between the connecting rod and the piston to the connection, or an axis thereof, between the connecting rod and the crankshaft.

In embodiments, the effective connecting rod length is defined by $C \geq 1.4142 \times (E+R)$, where C is the effective connecting rod length, R is the crankshaft throw radius and E is the effective crankshaft offset. In embodiments, $C \geq 1.5 \times (E+R)$ or even $C \geq 1.6 \times (E+R)$.

In embodiments, for example where $C=1.4142 \times (E+R)$, the difference between the first angle and the second angle is defined by the following formula:

$$Diff = \sin^{-1}\left(\frac{E}{C+R}\right) - \sin^{-1}\left(\frac{E}{C-R}\right)$$

where:

R is the crankshaft throw radius;

C is the distance between each crank journal and the piston connector to which it is connected via the connecting rod; and E is the effective crankshaft offset.

The engine may comprise first and second piston connectors. The pair of crankshafts may comprise first and second crankshafts and/or the pair of connecting rods may comprise first and second connecting rods. The first connecting rod may be connected at its first end to the first crankshaft, e.g. to the crank journal thereof, and/or at its second end to the piston, e.g. the first piston connector. The second connecting rod may be connected at its second end to the second crankshaft, e.g. the crank journal thereof, and/or at its second end to the piston, e.g. the second piston connector.

The first crankshaft may be on a first side of the piston and/or the second crankshaft may be on a second side of the piston. In some embodiments, the first piston connector is on the first side of the piston and the second piston connector is on the second side of the piston. In other embodiments, the first and second piston connectors are coaxial and/or intersect the centerline of the piston. In some embodiments, one of the connecting rods comprises a forked end, e.g. a forked small end and/or a pair of opposed rings or bushings. The other connecting rod may comprise an end, e.g. small end and/or ring or bushing, that is received or receivable by the forked end, e.g. between the opposed rings or bushings of the forked end. The connecting rods may comprise or form a fork-and-blade arrangement, for example, such that the first and second piston connectors are coaxial and/or intersect the centerline of the piston.

The engine may comprise a crankcase and/or a bearing carrier, which may be mounted to the crankcase and/or comprise or be formed of a different material to the crankcase. The bearing carrier may have one or more, e.g. a pair of, receptacles, which may be for receiving a bearing, e.g. a respective bearing. In embodiments, the bearing carrier has a pair of receptacles each receiving a bearing to which one of the crankshafts is mounted.

The engine or bearing carrier may comprise a lubricant port, which may be associated with one or both of the receptacles, e.g. for introducing lubricant to the bearing or bearings. In embodiments, the engine or bearing carrier comprises a lubricant port associated with each receptacle for introducing lubricant to the bearings, e.g. each bearing.

The engine may comprise a pair of output shafts, at least one or each having an end connected or coupled to one or a respective one of the crankshafts. Alternatively, the engine may comprise an output shaft connected to both crankshafts.

The engine may comprise an inlet valve, e.g. for introducing air and/or fuel into the cylinder. The engine may comprise an exhaust valve, e.g. for exhausting a gas from the cylinder. The engine may be configured such that the inlet valve opens between 15 and 25 degrees, for example between 18 and 22 degrees, e.g. about 20 degrees, before the piston reaches the or a top dead centre position. The engine may be configured such that the inlet valve closes between 40 and 50 degrees, e.g. about 45 degrees, after the piston reaches the or a bottom dead centre position. The engine may be configured such that the exhaust valve opens between 40 and 50 degrees, e.g. about 45 degrees, before the piston reaches the or a bottom dead centre position. The engine may be configured such that the exhaust valve closes between 15 and 25 degrees, e.g. about 20 degrees, after the piston reaches the or a top dead centre position.

The aforementioned inlet and exhaust valve open and closed positions may alternatively be expressed in relation to the crankshaft uppermost, upper, home, zero degree, zero or crankshaft top dead centre position and/or the crankshaft lowermost, lower, 180 degree or crankshaft bottom dead centre position. It will be appreciated that such positions will depend upon the crankshaft positions when the piston is at its top dead centre and bottom dead centre positions.

In some embodiments the crankshafts are coupled together by one or more, e.g. two or more or a plurality of intermeshing gears. The engine may comprise a first gear, which may be coupled or secured or mounted for rotation with one of the crankshafts, e.g. the first crankshaft. The engine may comprise a second gear, which may be coupled or secured or mounted for rotation with another of the crankshafts, e.g. the second crankshaft. The engine may comprise one or more further gears connecting the first and second gears together. The gears, e.g. the intermeshing gears or the first, second and further gears, may be operable or configured or for synchronising rotation of the crankshafts.

The engine may comprise a crankshaft stabilising or synchronising means. In some embodiments, the crankshafts are coupled together by a timing belt, e.g. a double-sided timing belt. The crankshaft synchronising means may be configured or arranged to synchronise the movement or rotation of each of the first and second crankshafts relative to one another.

The engine may comprise a first gear, which may be coupled or secured or mounted for rotation with one of the crankshafts, e.g. the first crankshaft. The engine may comprise a second gear, which may be couple or secured or mounted for rotation with another of the crankshafts, e.g. the second crankshaft. The engine may comprise at least one tensioning pulley, which may comprise a tension gear coupled or secured thereto or mounted for rotation therewith.

The engine may comprise a first tensioning pulley, which may be located above the crankshafts, e.g. on a first side of a plane intersecting the axes of rotation of the crankshafts. The engine may comprise a second tensioning pulley, which may be located below the crankshafts, e.g. on a second side of a plane intersecting the axes of rotation of the crankshafts. The first tensioning pulley may comprise a first tension gear coupled or secured thereto or mounted for rotation therewith. The second tension pulley may comprise a second tension gear coupled or secured thereto or mounted for rotation therewith. The timing belt may pass at least partially around each of the first and second gears and at least partially around the or each tension gear, e.g. each of the first and second tension gears. The timing belt may be configured to synchronise the rotation of the crankshafts.

The engine may comprise a camshaft stabilising or synchronising means. The camshaft stabilising or synchronising means may comprise or be provided by the timing belt. The engine may comprise a camshaft drive pulley, which may comprise a gear coupled or secured or mounted for rotation therewith. The timing belt may pass at least partially around the camshaft drive pulley or gear, for example so as to synchronise rotation of the camshaft and first and second crankshafts.

A first side of the timing belt may engage or intermesh the first gear and a second side of the timing belt may engage or intermesh the second gear. Alternatively, a first side of the double-sided timing belt may engage the second gear and the second side of the timing belt may engage the first gear.

The engine may comprise a piston stabilising or synchronising means, which may comprise an assembly. The piston stabilising or synchronising means may be configured or arranged to inhibit rocking of the piston within the cylinder. The piston stabilising or synchronising means may be configured or arranged to mitigate, balance or accommodate asymmetrical forces exerted by the connecting rods. The piston stabilising or synchronising means may be configured or arranged to synchronise the movement or rotation of each of the first and second connecting members relative to the piston and/or relative to one another. The piston stabilising or synchronising means may be arranged such that, in use, movement of the second ends of the first and second connecting rods relative to one another is restricted.

The first connecting rod may comprise a first engaging means, for example at or adjacent its second end, and/or the second connecting rod may comprise a second engaging means, for example at or adjacent its second end. The first and second engaging means may cooperate or interengage to provide the piston stabilising or synchronising means.

In some embodiments, the piston stabilising or synchronising means comprises cooperating teeth or gear teeth. For example, the first and second engaging means may each comprise a set of teeth. The sets of teeth may be configured to intermesh.

In some embodiments the piston stabilising or synchronising means comprises a biasing means or biaser, for example a resilient biasing means or biaser, interconnecting the first and second connecting rods. The biasing means or biaser may comprise a torsion spring.

The first connecting rod may comprise a first retaining pin or peg (hereinafter pin) and the second connecting rod may comprise a second retaining pin or peg (hereinafter pin). In use, the resilient biasing means may be held in tension between the first and second retaining pins.

In some embodiments, the piston stabilising or synchronising means may comprise a gimbal or knuckle, for example a gimbal or knuckle member or housing. The second end of at least one or each of the first and second connecting rods may be connected or mounted, e.g. pivotally or rotatably connected or mounted, to the gimbal or knuckle. The gimbal or knuckle may be mounted, e.g. pivotally or rotatably mounted, to or on or at least partially within the piston. The gimbal or knuckle may be received at least in part within the piston, e.g. a cavity thereof. The gimbal or knuckle may be configured such that, in use, rotation thereof is at least partially independent of the piston rotation.

The connection between the connecting rods and gimbal or knuckle, e.g. the axis of rotation thereof, and the axis of rotation of the gimbal or knuckle relative to the piston may be triangulated or may form a triangulated arrangement. Alternatively, the connection between the connecting rods and gimbal or knuckle, e.g. the axis of rotation thereof, and the axis of rotation of the gimbal or knuckle relative to the piston may be triangulated or may lie in the same plane.

The gimbal or knuckle may cooperate with the piston to inhibit rocking of the piston within the cylinder. The gimbal or knuckle may cooperate with the piston to mitigate, balance or accommodate asymmetrical forces exerted by the connecting rods. The gimbal or knuckle may cooperate with the piston to prevent asymmetrical forces exerted by the connecting rods from being transmitted to the piston.

Another aspect of the invention provides an internal combustion engine comprising a crankcase and a bearing carrier mounted to the crankcase, the bearing carrier being formed of a different material to the crankcase and having one or more receptacles for receiving a rotating shaft or a bearing to which a rotating shaft is mounted.

The rotating shaft may comprise a crankshaft of the engine. The engine may comprise two crankshafts. The engine may comprise a pair of connecting rods each having a first end connected to a respective one of the crankshafts, e.g. a crank journal thereof, and a second end connected to a piston of the engine, e.g. by a piston connector. The engine may be configured such that the piston stroke in a first direction e.g. toward the crankshafts, causes each crankshaft to rotate by a first angle and/or the piston stroke in a second direction e.g. opposite the first direction, causes each crankshaft to rotate by a second angle, e.g. different from the first angle.

Another aspect of the invention provides a piston stabilising assembly comprising a piston, a gimbal or knuckle pivotally received at least partially within the piston and a pair of connecting rods pivotally mounted to the knuckle member to mitigate asymmetrical forces exerted by the connecting rods.

Another aspect of the invention provides a generator comprising an engine as described above.

Another aspect of the invention provides a vehicle comprising an engine as described above. The vehicle may comprise a land vehicle, e.g. an automobile, a water vehicle, for example a boat or ship, or an air vehicle, for example an aeroplane, airship or zeppelin.

For the avoidance of doubt, any of the features described herein apply equally to any aspect of the invention. Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from and/or incorporate any feature of any other claim although not originally claimed in that manner.

Embodiments of the invention will now be described by way of example only with reference to the accompanying drawings in which.

Figure 1:
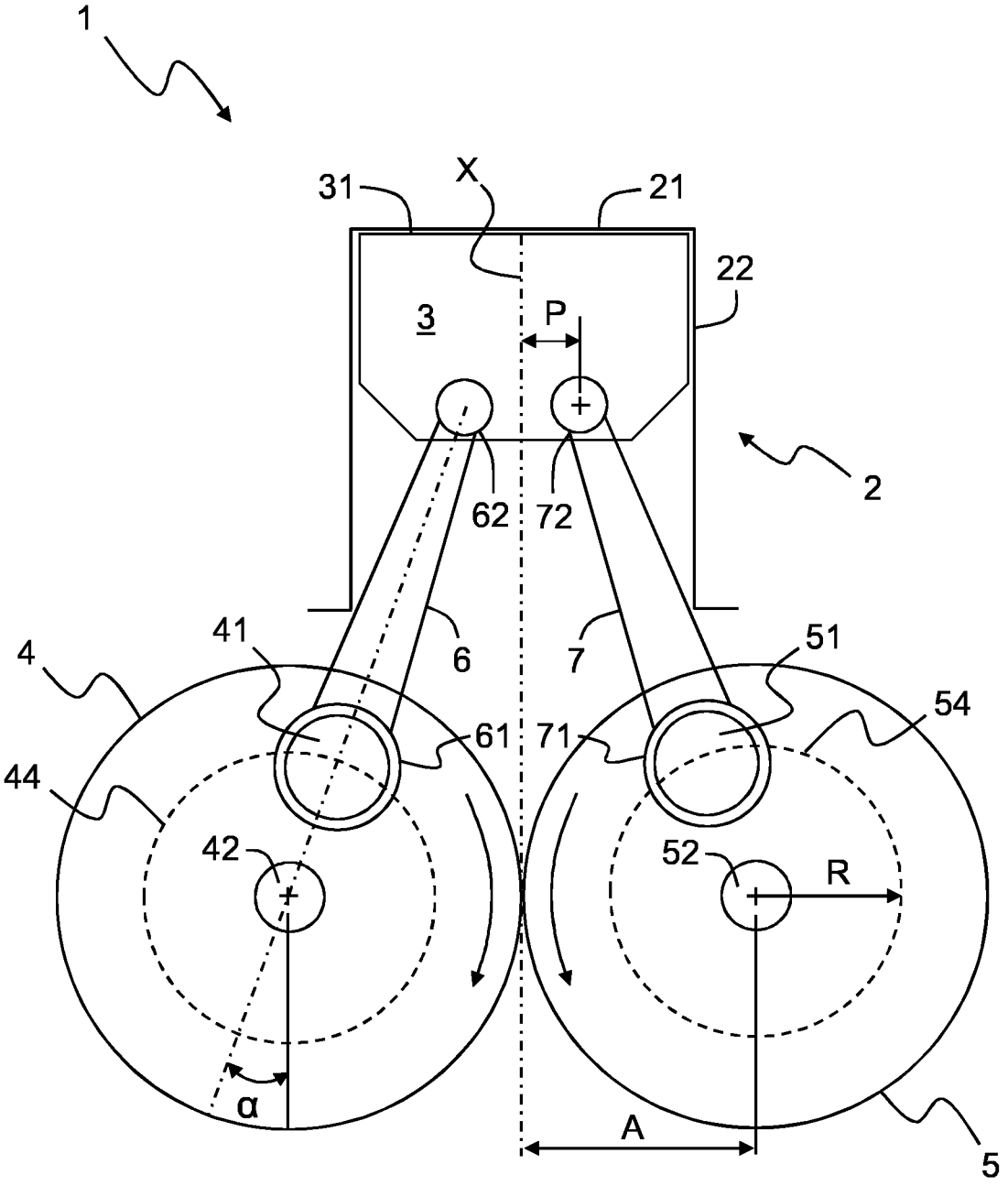
FIG. 1 is a schematic representation of an internal combustion engine according to an embodiment of the invention with the piston shown at a top dead centre position.

Referring now to FIGS. 1 to 4, there is shown an internal combustion engine 1, which is a compression ignition engine in this embodiment. The engine 1 includes a piston cylinder 2 and a piston 3 reciprocably received within the cylinder 2 in the usual way. As the skilled person will appreciate, the internal combustion engine 1 of the present invention follows similar operating principles to conventional internal combustion engines, which will not be described explicitly herein.

In accordance with the invention, the engine 1 includes a first crankshaft 4 and a second crankshaft 5 each on a respective side of the piston 3 and cylinder 2. More specifically, the first crankshaft 4 is on a first side of the piston 3 and the second crankshaft 5 is on a second side thereof. The engine 1 also includes a first connecting rod 6 and a second connecting rod 7 each having a first end 61, 71 connected to a crank journal 41, 51 of a respective one of the crankshafts 4, 5 and a second end 62, 72 connected to the piston 3. The arrangement of the engine 1 is symmetrical such that the geometry of the assembly associated with the first crankshaft 4 is effectively mirrored by the assembly associated with the second crankshaft 5.

The cylinder 2 in this embodiment defines a substantially cylindrical cavity having a cylinder head 21, a side wall 22 and an open end 23 for receiving the piston 3. The piston 3 has an upper surface 31 opposite the cylinder head 21 such that the cylinder head 21, side wall 22 and the upper surface 31 of the piston 3 form a combustion chamber 24. The volume of the combustion chamber 24 varies with the position of the piston 3 along the piston cylinder 2. The common centerline of the piston 3 and cylinder 2 is projected to define a piston centerline X corresponding to the reciprocating axis of the piston 3.

The piston 3 is also substantially cylindrical and has a pair of pin receiving apertures 32, 33 which receive a pair of piston pins 34, 35 disposed generally perpendicularly with respect to the piston centerline X or reciprocating axis. Each respective pin receiving aperture 32, 33 is equidistant from and positioned on a respective side of the piston centerline X. More particularly, a first pin receiving aperture 32 is on the first side of the piston 3 and receives a first piston pin 34, while a second pin receiving aperture 33 is on the second side of the piston 3 and receives a second piston pin 35. A piston connection offset P is described by the offset between the central axis of each pin receiving aperture 34, 35 and the piston centerline X.

Each of the pair of crankshafts 4, 5 includes a main bearing 42, 52 and the path along which each crank journal 41, 51 moves during operation of the engine 1 is illustrated by circular paths 44, 54. The radius of the circular paths 44, 54 corresponds to a crank throw radius R. The crankshafts 4, 5 are coupled together by meshing gears (not shown) such that the crankshafts 4, 5 remain synchronised to avoid any load being distributed unevenly. The engine 1 in this embodiment is configured such that the crankshafts 4, 5 contra-rotate as indicated by the arrows 43, 53.

As explained above, the crankshafts 4, 5 are equidistant to and positioned on a respective side of the piston centerline X. A crankshaft offset A is described by the distance between the central axis of each of the main bearings 42, 52, or the axis of rotation of each crankshaft 4, 5, and the piston centerline X. An effective crankshaft offset E is described by the offset between the central axis of a respective piston pin 34, 35 and the central axis of a respective main bearing 42, 52. The effective offset E can also be described as the difference between the crankshaft offset A and the piston pin offset P.

In some embodiments, power delivery from the engine 1 is delivered by connecting or coupling the output from each crankshaft 4, 5 to a respective one of a pair of output shafts (not shown). In other embodiments, the pair of crankshafts 4, 5 connect to a common output (not shown) which in turn is connected to a single output shaft (not shown).

The first connecting rod 6 is rotatably connected to the crank journal 41 of the first crankshaft 4 at its first end 61 and to the first piston pin 34 at its second end 62. The second connecting rod 7 is rotatably connected to the crank journal 51 of the second crankshaft 5 at its first end 71 and to the second piston pin 35 at its second end 72. Accordingly, each connecting rod 6, 7 is on a respective side of the piston centerline X such that they do not cross one another at any point along their length during operation of the engine 1. Each of the connecting rods 6, 7 has a length C described by the distance between the axis of rotation of a respective crank journal 41, 51 and the central axis of a respective piston pin 34, 35.

The Applicant has observed that it is important for efficient operation of the engine 1 that the piston pin offset P is less than the distance described between the piston centerline X and the crank journals 41, 51 at their nearest position thereto. This ensures that the piston 3 under an applied force is supported on a triangulated structure.

Each of the crankshafts 4, 5 has a crankshaft top dead centre position and a crankshaft bottom dead centre position. The crankshaft top dead centre position corresponds to the position of the crankshaft 4, 5 when its crank journal 41, 51 is at an uppermost or home position. The crankshaft bottom dead centre position corresponds to the position of the crankshaft 4, 5 when its crank journal 41, 51 is at a lowermost or 180 degree position.

Figure 2:
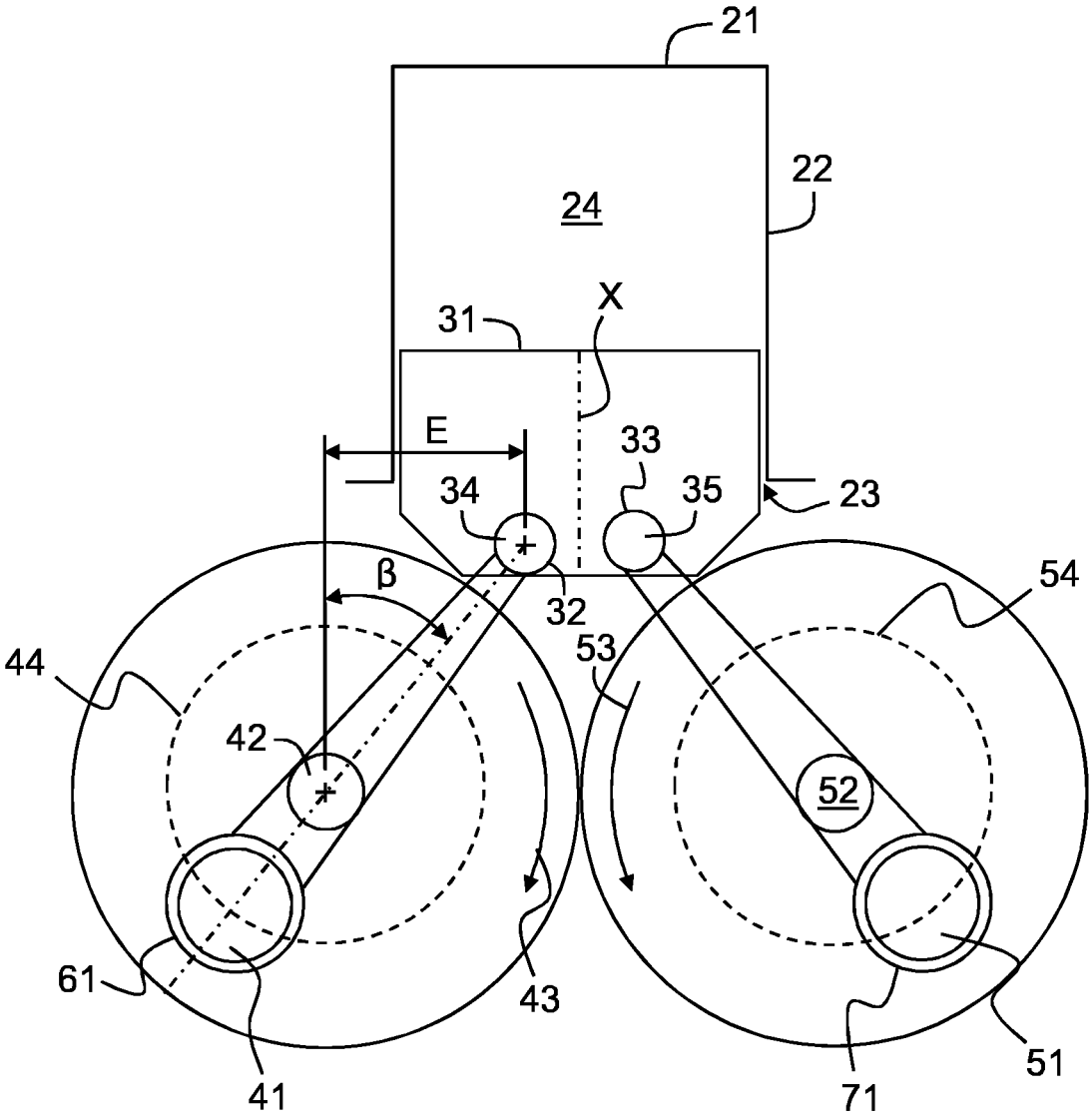
FIG. 2 is a schematic representation similar to FIG. 1 with the piston shown at a bottom dead centre position.

As shown in FIG. 1, the piston top dead centre position occurs when the crank journal 41, 51 is at an angle $\alpha$ beyond the crankshaft top dead centre position. As shown in FIG. 2, the piston bottom dead centre position occurs when the crank journal 41, 51 is at an angle $\beta$ beyond the crankshaft bottom dead centre position.

Figure 3:
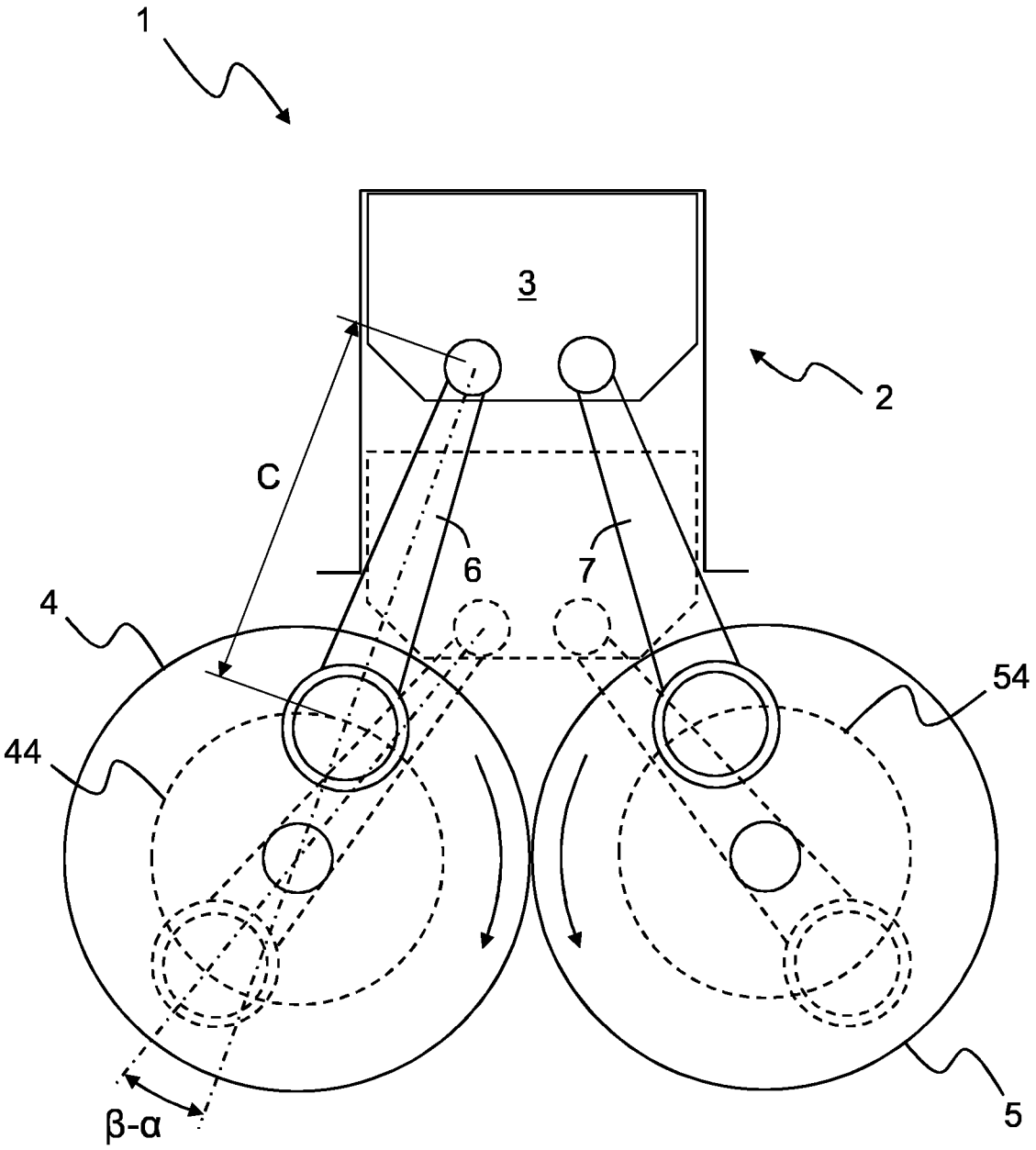
FIG. 3 is a schematic representation similar to FIGS. 1 and 2 with the piston shown at a top dead centre position overlaid with the piston shown at a top dead centre position.

FIG. 3 illustrates the internal combustion engine 1 with the configuration of FIG. 2 overlaid upon the configuration of FIG. 1. As shown, the angular rotation of the crankshafts 4, 5 required for the piston to travel from piston top dead centre to piston bottom dead centre is greater than the angular rotation of the crankshafts 4, 5 required for the piston to travel from piston bottom dead centre to piston top dead centre. Thus, a degree of asymmetry $\delta$ is described by this difference in crankshaft rotation ($\beta-\alpha$).

As explained above, the present invention is based on the realisation that the degree of asymmetry $\delta$ presents opportunities for improving the efficiency of the engine 1. The aforementioned configuration The degree of asymmetry $\delta$ can be controlled by changing the effective crankshaft offset E. In the present invention, the inclusion of two crankshafts 4, 5 each having a respective connecting rod 6, 7 connected to the same piston 3 allows asymmetry $\delta$ to be imparted to the engine 1, whilst countering the deleterious effects of side thrust that would otherwise arise from a single crankshaft arrangement.

Increasing the asymmetry $\delta$ of the engine 1 increases the angular displacement of the crankshafts 4, 5 required for the piston to travel from top dead centre to bottom dead centre. In contrast, increasing the asymmetry $\delta$ of the engine 1 decreases the angular displacement of the crankshafts 4, 5 required for the piston to travel from bottom dead centre to top dead centre. The skilled person will appreciate that the asymmetry $\delta$ of the engine 1 results in a difference of $2\delta$ between the extent of rotation of the crankshaft 4, 5 during the downstroke of the piston 3 from top dead centre to bottom dead centre as compared with its upstroke from bottom dead centre to top dead centre.

In a four-stroke cycle, this asymmetry $\delta$ results in induction and power strokes which are extended as compared with compression and exhaust strokes. Whilst not wishing to be bound by any particular theory, it is believed that extending the induction stroke provides an improvement in volumetric filling, while extending the power stroke allows more energy to be transferred to the piston 3 as useful work. It is also believed that shortening the compression and exhaust strokes reduces leakage past the piston 3 and valves (not shown).

Imparting asymmetry $\delta$ to the engine 1, while optimising its efficiency, involves an interplay between the design parameters that has not been appreciated or understood hitherto. The Applicant has observed that the aforementioned improvement in performance of the engine 1 is particularly advantageous where the asymmetry $\delta$ of the engine 1 is between 9 and 25 degrees. In diesel engines, the asymmetry $\delta$ of the engine 1 is more preferably between 14 and 20 degrees and most preferably between 16 and 18 degrees, for example about 17 degrees. It is estimated that an asymmetry of 17 degrees provides an increase in induction and power strokes of approximately 10% as compared to a symmetrical engine configuration. This, in turn, results in the downstroke of the piston 3 being 20% longer than the upstroke thereof for a given rotational speed of the crankshafts 4, 5.

Figure 4:
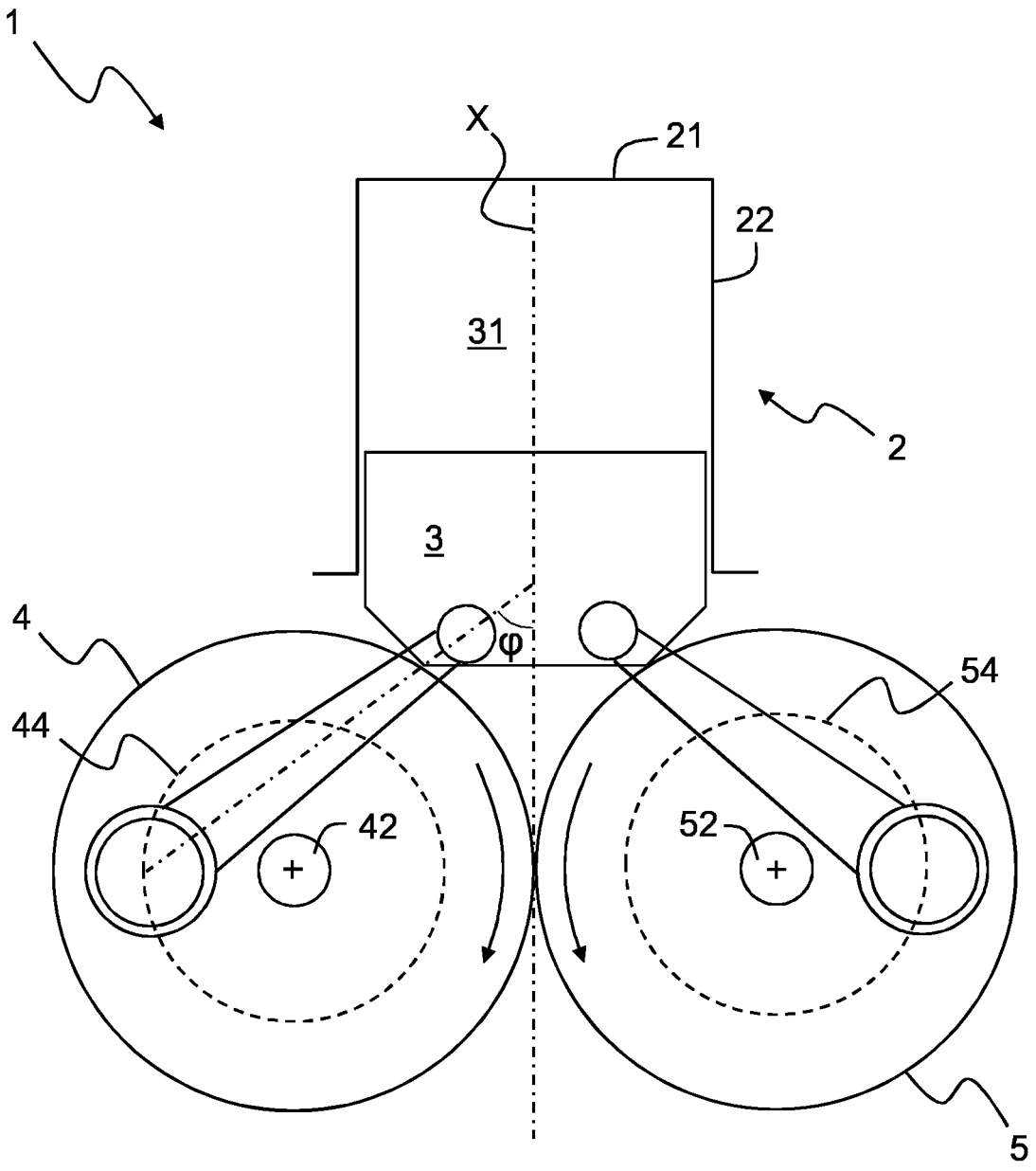
FIG. 4 is a schematic representation similar to FIGS. 1 to 3 with the piston shown in an intermediate position corresponding to the maximum angle between the connecting rod and the piston centerline.

Turning now to FIG. 4, a connecting rod angle $\varphi$ is described between each of the respective connecting rods 6, 7 and the piston centerline X. If the connecting rod angle $\varphi$ exceeds 45°, the component of force on the piston 3 acting perpendicular to the piston centerline X will be greater than the component of force acting along the piston centerline X. This has a deleterious effect on the engine efficiency due to increased side thrust force between the piston 3 and the piston cylinder side wall 22 and it is therefore important that $\varphi \leq 45°$.

It has been found that a relationship between connecting rod length C, crank throw radius R and effective crankshaft offset E for $\varphi \leq 45°$ can be defined by as follows:

$$C \geq 1.4142(E+R) \tag{1}$$

Additionally, for $\varphi \leq 45°$ the degree of asymmetry δ can be calculated using the following formula:

$$\delta = \sin^{-1}\left(\frac{E}{C-R}\right) - \sin^{-1}\left(\frac{E}{C+R}\right) \tag{2}$$

The skilled person will appreciate from the above example that the asymmetry δ may be calculated for any given engine geometry using similar principles.

The Applicants have also determined that the relationship between the crank throw radius R and effective crankshaft offset E can advantageously be defined by the following formula:

$$E = F \times R \tag{3}$$

where the effective offset factor F is 1.65. Preferably, however, the effective crankshaft offset factor F is between 1.4 and 1.9, more preferably between 1.5 and 1.8 and most preferably between 1.6 and 1.7.

In one example, the crank throw radius R is 38 mm. Therefore, from Equation 3 the effective crankshaft offset E is 62.7 mm. Using Equation 1 this requires an effective connecting rod length C of at least 142.41 mm. If the effective connecting rod length C is 142.41 mm, using Equation 2 provides a degree of asymmetry δ of 16.56°.

It will be appreciated by those skilled in the art that several variations to the aforementioned example are envisaged. For example, the following provides exemplary engine 1 design parameters in accordance with the present invention:

| Crank throw radius R (mm) | Effective crankshaft offset E (mm) | Minimum connecting rod length C (mm) | Asymmetry δ at minimum C (°) |
|---|---|---|---|
| 38.5 | 63.525 (F = 1.65) | 144.28 | 16.571 |
| 39 | 64.35 (F = 1.65) | 146.4 | 16.3 |
| 39.5 | 65.175 (F = 1.65) | 148.03 | 16.5703 |

In use and during the power stroke, an input force from the expansion of gas within the combustion chamber 24 acts on the piston 3. This force acts on the upper surface 31 of the piston 3 and drives the downstroke. The force is transmitted from the piston 3 via the piston pins 34, 35 to the connecting rods 6, 7 and therefrom to crank journals 41, 51 and crankshafts 4, 5. The transmission of force causes the crankshafts 4, 5 to rotate substantially symmetrically and in opposite directions about their respective main bearings 42, 52.

As the crankshaft 4, 5 rotates, the crank journals 41, 51 follow the path defined by circles 44, 54. The reaction force by each of the connecting rods 6, 7 on the piston 3 is balanced due to their symmetry and due to the meshing gears (not shown). The piston 3 travels along the piston cylinder 2 from top dead centre to bottom dead centre and the crankshafts 4, 5 rotate through a first angle corresponding to 180°+δ. In the specific embodiment described above, the first angle is therefore 196.56°.

During the exhaust stroke, the momentum of the crankshafts 4, 5 drives the piston 3 from bottom dead centre to top dead centre. This movement corresponds to a rotation of the crankshafts through a second angle corresponding to 180°−δ. In the specific embodiment described above, the first angle is therefore 163.44°.

Figure 5:
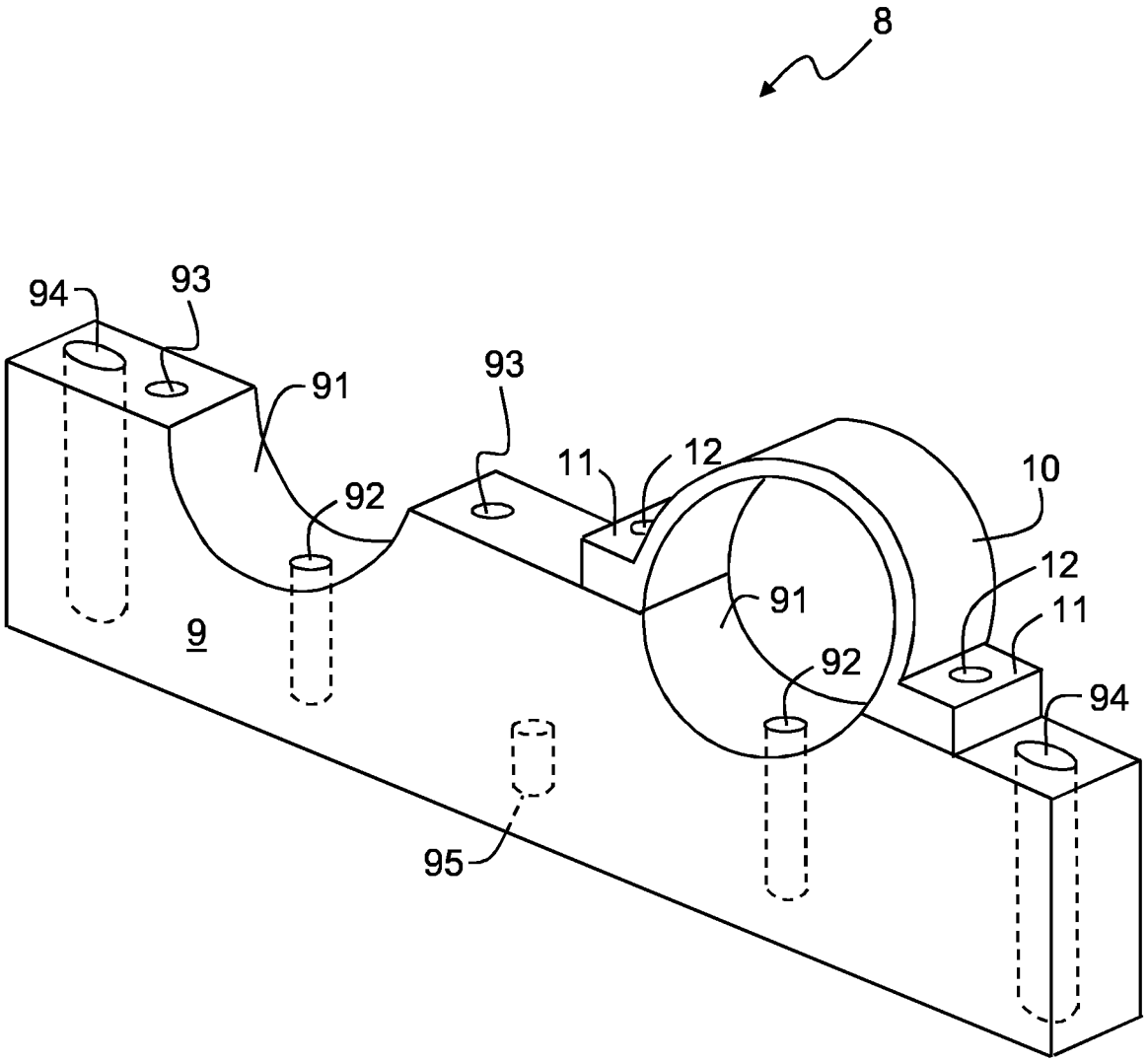
FIG. 5 is a perspective view of a bearing carrier of the engine of FIGS. 1 to 4.

Referring now to FIG. 5, there is shown a bearing carrier 8 mounted to the crankcase (not shown) of the engine 1 of FIGS. 1 to 4. The bearing carrier 8 has a main body 9 and a pair of bearing caps 10 (only one of which is shown). The bearing carrier 8 is formed of a different material to the crankcase (not shown). In this embodiment, crankshafts 4, 5 are formed of steel, the crankcase (not shown) is formed of an aluminium alloy and the bearing carrier 8 is formed of steel. The bearing carrier 8 is designed to mitigate the effects of the differing thermal expansion between the aluminium alloy of the crankcase and the steel crankshafts 4, 5.

The main body 9 is a cuboid and has a pair of spaced apart semi-circular cut-away portions 91. Each semi-circular cut-away portion 91 is sized and dimensioned to receive a respective bearing 42, 52 to which one of the crankshafts 4, 5 is rotatably mounted. The main body 9 also includes a pair of lubrication ports 92 each communicating with one of the cut-away portions 91. The main body 9 further includes a pair of threaded bearing cap mounting holes 93 positioned on either side of each of the semi-circular cut-away portions 91, outer mounting holes 94 for fixing the bearing carrier 8 to the crank case (not shown) of the engine 1 and dowel pin hole 95. The dowel pin hole 95 is configured to receive a dowel pin to locate the main body 9 relative to the crankcase (not shown) and the outer mounting holes 94 are oval in cross section to allow movement of the bearing carrier 8 to accommodate differential thermal expansion between the bearing carrier 8 and crank case (not shown).

The bearing caps 10 are semi-circular and configured to cooperate with the semi-circular cut-away portions 91 of the main body 9 to captivate the bearings 42, 52 therebetween. Each bearing cap 10 also includes a pair of mounting flanges 11 projecting perpendicularly from either side thereof. Each mounting flange 11 has an aperture 12 extending therethrough for receiving a screw or bolt (not shown) for threadedly engaging the bearing cap mounting holes 93 to allow attachment of the bearing cap 10 to the main body 9.

In use, the main bearings 42, 52 of the crankshafts 4, 5 are captivated between the bearing caps 10 and the semi-circular cut-away portions 91. Each lubricant port 92 forms a fluid connection between a lubricant supply (not shown) and the main bearings 42, 52 to enable lubrication to be applied thereto.

In this embodiment, the lower surface of the main body 9 is highly polished and the lubricant port 92 is aligned with a port of the main oil-ways in the crankcase. As a result, movement of the bearing carrier 8 to accommodate differential thermal expansion between the bearing carrier 8 and crank case (not shown) results in a small amount of leakage, which lubricates the opposed surfaces. However, it is also envisaged that the connection between the lubricant port 92 is aligned with a port of the main oil-ways in the crankcase (not shown) may be sealed, for example by O-rings received in grooves in either the crankcase (not shown) or the lower surface of the main body 9. In such embodiments, a gasket (not shown) may be provided between the facing surfaces of the main body 9 and the crankcase (not shown).

Figure 6:
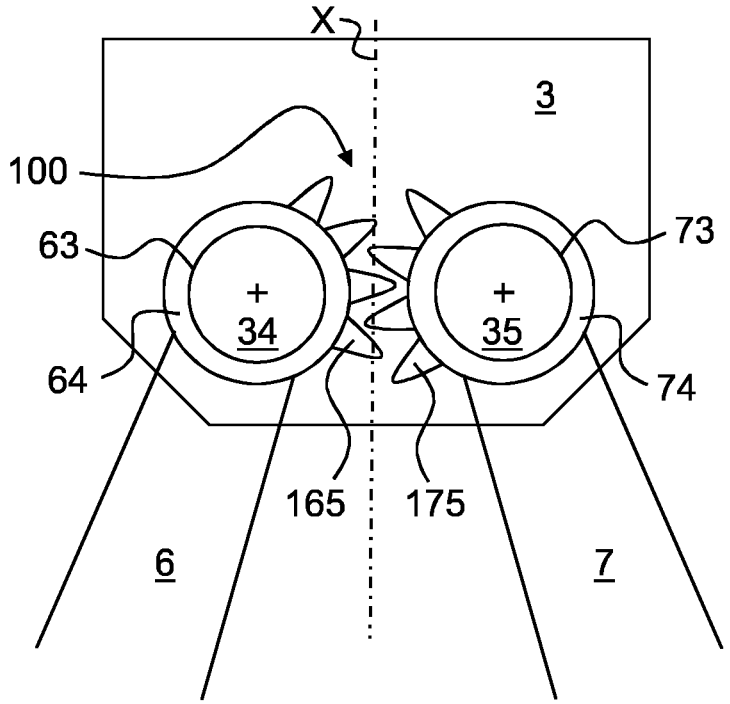
FIG. 6 is a schematic representation of a piston stabilising mechanism for use in an engine according to an embodiment of the invention.

Referring now to FIG. 6, there is shown an arrangement similar to that of the engine 1 described above, in which like features to those of previous Figures are denoted by like references and will not be described further. This arrangement differs from that of previous Figures in that a piston stabilising mechanism 100 is provided to inhibit rocking of the piston 3 within the cylinder 2 by balancing asymmetrical forces exerted by the connecting rods 6, 7.

Each of the connecting rods 6, 7 have respective bearings 63, 73 (shown as bearing surfaces for simplicity) surrounding the respective piston pins 34, 35. The bearings 63, 73 are surrounded by respective bearing shells 64, 74. In the present embodiment, the piston stabilising mechanism 100 takes the form a set of teeth 165, 175 (only some of which are shown for simplicity) formed on and projecting from an outer surface of each of the bearing shells 64, 74. The teeth 165, 175 are configured to intermesh as the respective second ends 62, 72 of the pair of connecting rods 6, 7 rotate relative to one another as piston 3 reciprocates.

The intermeshing teeth 165, 175 restrict the extent to which the pair of connecting rods 6, 7 can move relative to one another as the piston 3 reciprocates. This is particularly relevant, in use, during the power stroke of the engine. Any unbalanced forces acting on the piston 3 from the expansion of gas within the combustion chamber (not shown) will be transmitted to the connecting rods 6, 7 via the respective piston pins 34, 35. The intermeshing teeth 165, 175 help to maintain a balanced piston 3 and reduce the likelihood of rocking of the piston 3 within the cylinder (not shown).

Figure 7:
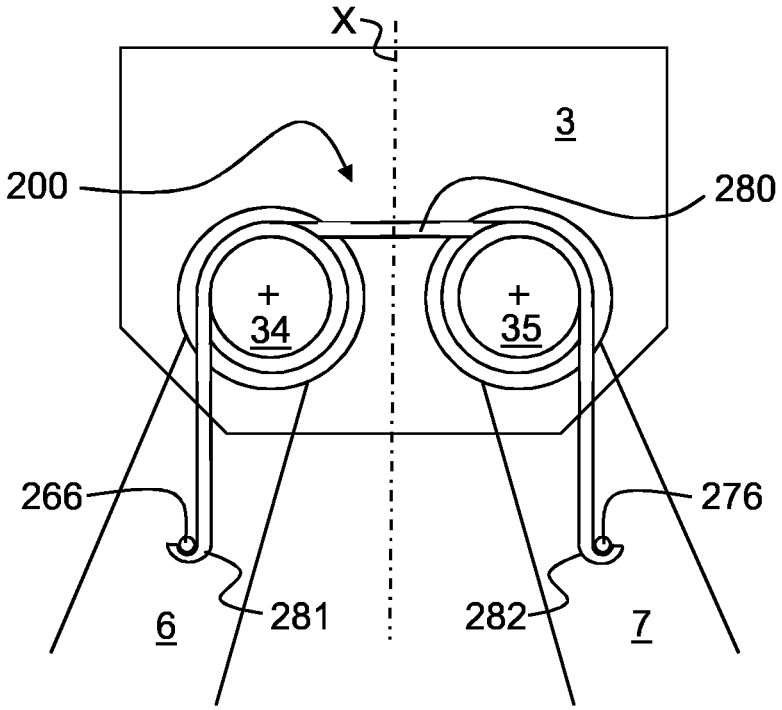
FIG. 7 is a schematic representation of an alternative piston stabilising mechanism for use in an engine according to an embodiment of the invention.

Referring now to FIG. 7 there is shown a piston stabilising mechanism 200 similar to the mechanism 100 of FIG. 6, wherein like features are denoted by like references and will not be described further. In the present embodiment, the first connecting rod 6 has a pin 266 projecting therefrom at a position spaced from its second end 62 and the second connecting rod 7 has a pin 276 projecting therefrom at a position spaced from its second end 72.

The piston stabilising mechanism 200 in this embodiment takes the form of a resilient biasing means in the form of a spring 280 in this embodiment. The spring 280 has a first end 281 hooked around the pin 266 of the first connecting rod 6, a second end 282 hooked around the pin 276 of the second connecting rod 7 and a pair of central windings around each of the first piston pin 34 and the second piston pin 35. The spring 280 exerts a torsional force on each of the connecting rods 6, 7 to urge them apart.

In use and in the event of unbalanced forces acting on the piston 3 from the expansion of gas within the combustion chamber or by any other means, the spring 280 will help to balance the piston 3 to mitigate rocking of the piston 3 within the cylinder (not shown).

It will be appreciated that while FIG. 7 shows the spring 280 wrapped around the piston pins 34, 35, this need not be the case. Instead, the spring 280 may be wrapped around the bearing shells 64, 74 or a specific holding lip or formation at the bearing shells 64, 74 or second ends 62, 72 of the connecting rods 6, 7. Further, it will be appreciated that the spring 280 may be replaced with any suitable resilient biasing means.

Figure 8:
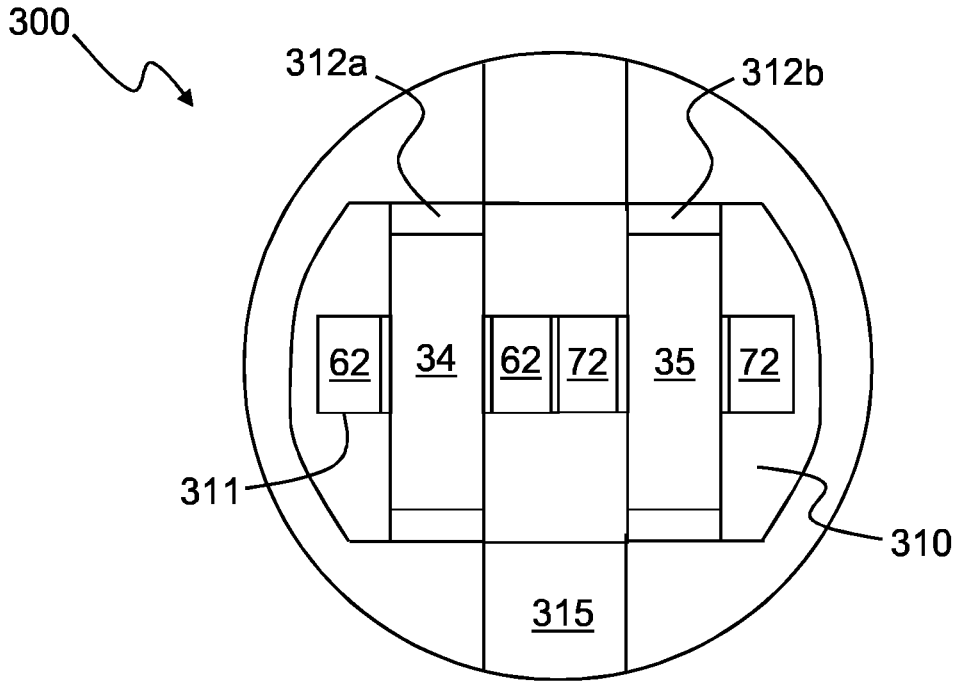
FIG. 8 is a section view through a further alternative piston stabilising mechanism for use in an engine according to an embodiment of the invention.
Figure 9:
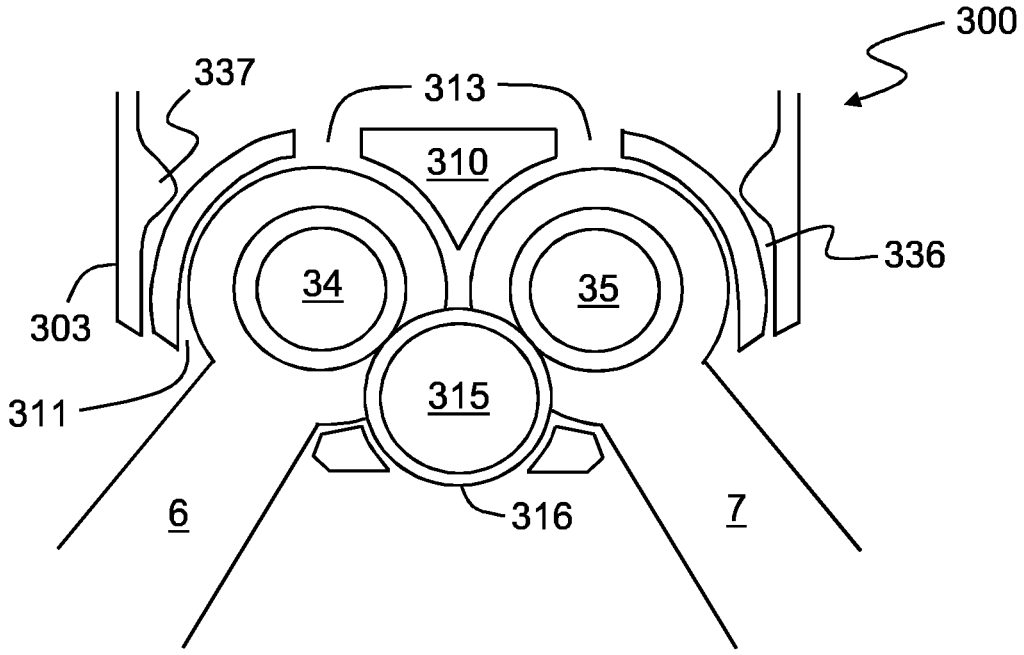
FIG. 9 is a schematic representation of the piston stabilising mechanism of FIG. 8.

Referring now to FIGS. 8 and 9, there is shown a piston stabilising mechanism 300 similar to the mechanism 100 of FIG. 6, wherein like features are denoted by like references and will not be described further. The piston stabilising mechanism 300 according to this embodiment includes a gimbal or knuckle housing 310 received within a cavity 336 of the piston 303. The housing 310 surrounds and partially encapsulates the second ends 62, 72 of the respective connecting rods 6, 7 and piston pins 34, 35.

The housing 310 has a slot 311 for receiving the second ends 62, 72 of the respective connecting rods 6, 7 and a pair of spaced apart second bores 312*a*, 312*b* orthogonal to and intersecting the slot 311. The bores 312*a*, 312*b* are arranged to receive a respective piston pin 34, 35 once the second ends 62, 72 of the connecting rods 6, 7 are received within the first slot 311.

The housing 310 has a pair of spaced apart lubricant ports 313 through its upper surface and in fluid communication with the first and second slots 311, 312*a*, 312*b* to enable the piston pins 34, 35 and the bearings 63, 73 to be lubricated. The piston 303 includes a loading lip 337 protruding from an inner surface defining the cavity 336. The loading lip 337 is configured to limit the extent to which the housing 310 is able to enter the cavity 336.

The piston stabilising mechanism 300 includes a pair of stub axles 315 located on opposing sides of the housing 310. The piston 303 in this embodiment has a pair of stub axle apertures 338 extending through a sidewall thereof and in communication with the cavity 336. The stub axles 315 are inserted through the stub axle apertures 338 and are shrink fitted therein.

The piston stabilising mechanism 300 also includes a pair of bearings 316, one for each stub axle 315, which is located between the stub axle aperture 38 and the stub axle 315. The stub axles 315 hold the piston stabilising mechanism 300 within the piston 303 and allow it to rotate relative to the piston 303 about their common axis. The stub axles 315 also transfer energy from the piston 303 to the connecting rods 6, 7.

In use, with the ends 62, 72 of the connecting rods 6, 7 located within the piston stabilising mechanism 300 and the entire assembly located within a piston 303, any imbalance between the connecting rods 6, 7 imparts a force to the piston 303 via the piston stabilising mechanism 300. As the housing 310 is free to rotate relative to the piston 303 about the stub axles 315, any imbalanced forces cause the piston stabilising mechanism 300 to rotate relative to the piston 303 and hence the piston 303 remains balanced.

Figure 10:
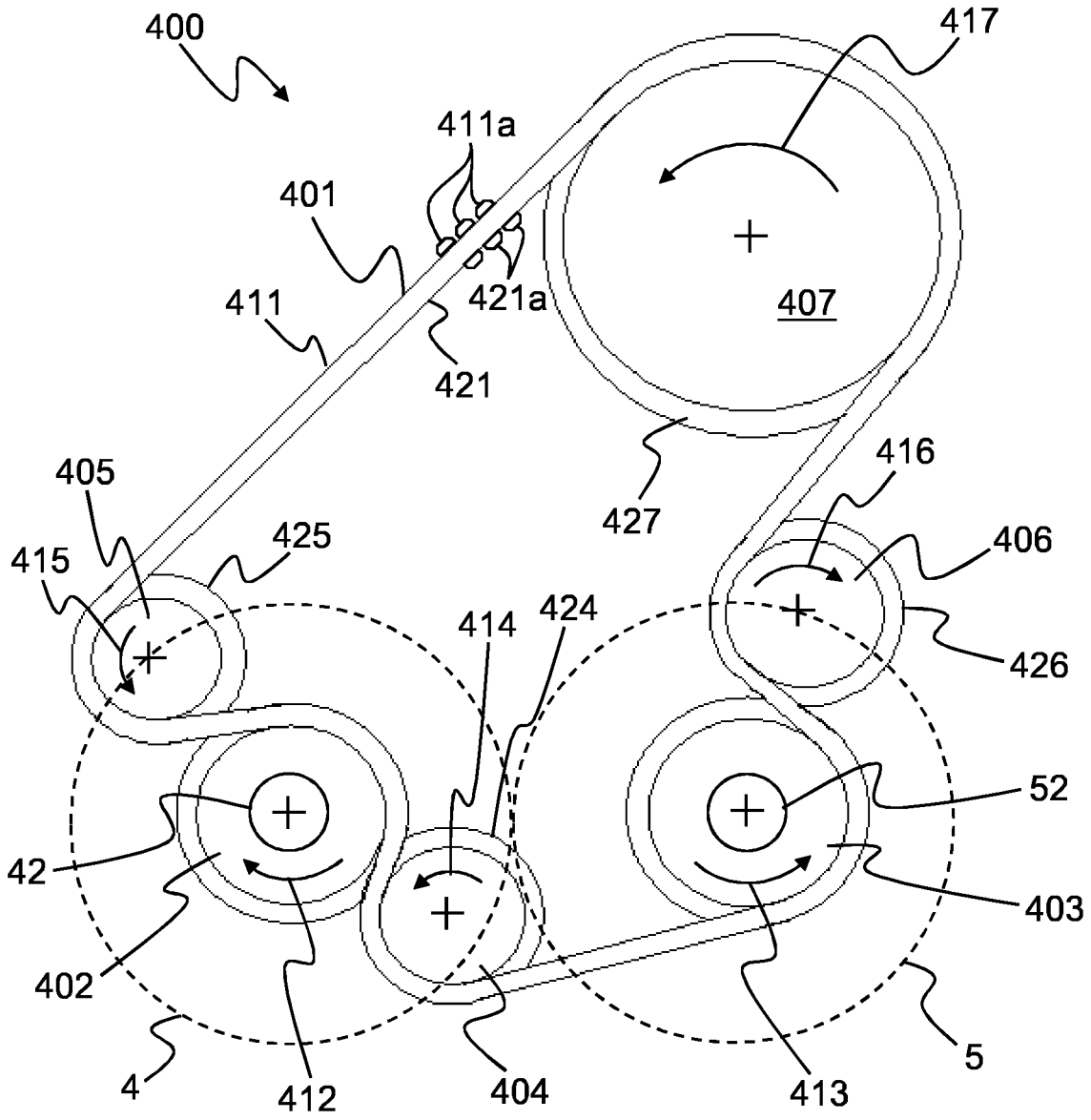
FIG. 10 is a schematic representation of a camshaft synchronising means according to an embodiment of the invention.

Referring now to FIG. 10, there is shown a crankshaft synchronising mechanism 400 according to an embodiment of the invention wherein like references to those of FIGS. 1-9 denote like features. The crankshaft synchronising mechanism 400 has a double-sided timing belt 401 having teeth 411*a*, 421*a* on both a first side 411 and a second side 421 of the timing belt 401.

The first and second crankshafts 4, 5 have respective main bearings 42, 52 as in previous embodiments. The first crankshaft 4 has a first gear 402 mounted for rotation therewith, which cooperates with gear teeth 411*a* on the first side 411 of the timing belt 401 and is configured to rotate in a clockwise direction 412 in the present embodiment. The second crankshaft 5 has a second gear 403 mounted for rotation therewith, which cooperates with gear teeth 421*a* on the second side 421 of the timing belt 401 and is configured to rotate in an anti-clockwise direction 413 in the present embodiment. The first crankshafts 4, 5 and their respective gears 402, 403 are therefore configured to counter-rotate.

The synchronisation mechanism 400 includes a first tensioning pulley 404 having a centre of rotation located below, on an lower side of a plane intersecting the axes of rotation of the first and second crankshafts 4, 5. The first tensioning pulley 404 has a geared outer surface forming a first tension gear 424 configured to inter-engage with the teeth 421*a* on the second side 421 of the timing belt 401 and is configured to rotate in an anti-clockwise direction 414.

The synchronisation mechanism 400 also includes second and third tensioning pulleys 405, 406 have respective centres of rotation that are located on a upper side of the plane intersecting the axes of rotation of the first and second crankshafts 4, 5 to that of the first tensioning pulley 404. In this embodiment, the second tensioning pulley 405 has a geared outer surface forming a second tension gear 425 configured inter-engage with the teeth 421*a* on the second side 421 of the timing belt 401 and is configured to rotate in an anti-clockwise direction 415. The third tensioning pulley 406 has a geared outer surface forming a third tension gear 426 configured to inter-engage with the teeth 411*a* on the first side 411 of the timing belt 401 and is configured to rotate in a clockwise direction 416.

The synchronisation mechanism 400 also includes a camshaft drive pulley 407 having a centre of rotation, which is also located above the crankshafts 4, 5. The camshaft drive pulley 407 has a geared outer surface forming a camshaft gear 427 configured to inter-engage with the teeth 421*a* on the second side 421 of the timing belt 401 and is configured to rotate in an anti-clockwise direction 417.

In use, the timing belt 401, by virtue of engagement with both of the first and second gears 402, 403 and camshaft gear 427 maintains synchronisation between the crankshafts 4, 5 relative to one another and also between the crankshafts 4, 5 and the camshaft drive pulley 407.

Although the camshaft drive pulley 407 rotates in an anti-clockwise direction, this need not be the case. Instead, the camshaft drive pulley 407 may rotate in a clockwise direction while maintaining clockwise rotation of the first gear 402 and anti-clockwise rotation of the second gear 403. The skilled person will appreciate that, in such a case, this can be achieved by reconfiguring the crankshaft synchronisation mechanism 400 such that the teeth 421*a* on the second side 421 of the timing belt 401 engage both the camshaft gear 427 and the first gear 402, with the teeth 411*a* on the first side 411 of the timing belt 401 engaging the second gear 403. The tension pulleys 404, 405 and 406 would also need to be reconfigured to accommodate such a reconfiguration.

It will also be appreciated that instead of having a crankshaft synchronisation mechanism which is configured to synchronise both crankshafts 4, 5 and camshaft drive pulley 407, the crankshaft synchronisation mechanism may synchronise the rotation of the crankshafts 4, 5 only. In such a case, there may be one or more tension pulleys with a centre of rotation one side of a plane intersecting the axes of rotation of the first and second crankshafts 4, 5 and one or more further pulleys with a centre of rotation the other side of the plane intersecting the axes of rotation of the first and second crankshafts 4, 5. Alternatively, the timing belt 401 may also drive one or more peripheral devices (not shown), as will be appreciated by those skilled in the art.

It will be appreciated by those skilled in the art that several variations are envisaged without departing from the scope of the invention. For example, the cross sectional shape of the piston cylinder 2 and piston 3 may be any suitable shape, such as oval or a complex polygon. It will also be appreciated by those skilled in the art that any number of combinations of the aforementioned features and/or those shown in the appended drawings provide clear advantages over the prior art and are therefore within the scope of the invention described herein.

The invention claimed is:

1. A compression ignition internal combustion engine comprising:

a cylinder;

a piston reciprocably received within the cylinder;

first and second contra-rotating crankshafts rotatably mounted relative to the cylinder;

a first connecting rod having a first end connected to a crank journal of the first crankshaft and a second end connected to the piston;

a second connecting rod having a first end connected to a crank journal of the second crankshaft and a second end connected to the piston;

a piston stabilizer configured to inhibit rocking of the piston within the cylinder by balancing the asymmetrical forces exerted by the first and second connecting rods;

wherein the piston stabilizer comprises a knuckle housing to which the second end of each of the first and second connecting rods is pivotally connected, the knuckle housing being pivotally mounted to and at least partially within the piston such that rotation thereof is at least partially independent of the piston rotation;

wherein the connection between the connecting rods and knuckle housing and the axis of rotation of the knuckle housing relative to the piston forms a triangulated arrangement;

wherein the engine is configured such that the piston stroke in a first direction toward the crankshafts causes each crankshaft to rotate by a first angle and the piston stroke in a second direction opposite the first direction causes each crankshaft to rotate by a second angle different from the first angle.

2. Engine according to claim 1, wherein the second angle is between 26 and 42 degrees less than the first angle.

3. Engine according to claim 2, wherein the second angle is between 32 and 36 degrees less than the first angle.

4. Engine according to claim 1 comprising:

a crankshaft throw radius described between an axis of rotation of each crankshaft and its crank journal; and an effective crankshaft offset described by the offset between the axis of rotation of each crankshaft and the piston connector to which its connecting rod is connected;

wherein the effective crankshaft offset is between 1.4 and 1.9 times the crankshaft throw radius.

5. Engine according to claim 4, wherein the effective crankshaft offset is between 1.6 and 1.7 times the crankshaft throw radius.

6. Engine according to claim 4, wherein each connecting rod comprises an effective connecting rod length C described between the crank journal and piston connector to which it is connected, the effective connecting rod length being defined by $C \geq 1.4142 \times (E+R)$, where R is the crankshaft throw radius and E is the effective crankshaft offset.

7. Engine according to claim 1, wherein the first crankshaft and the first piston connector are both on a first side of the piston and the second crankshaft and the second piston connector are both on a second side of the piston.

8. A compression ignition internal combustion engine comprising:

a cylinder;

a piston reciprocably received within the cylinder;

first and second contra-rotating crankshafts rotatably mounted relative to the cylinder;

a first connecting rod having a first end connected to a crank journal of the first crankshaft and a second end connected to the piston by a first piston connector;

a second connecting rod having a first end connected to a crank journal of the second crankshaft and a second end connected to the piston by a second piston connector;

wherein the engine is configured such that the piston stroke in a first direction toward the crankshafts causes each crankshaft to rotate by a first angle and the piston stroke in a second direction opposite the first direction causes each crankshaft to rotate by a second angle different from the first angle;

wherein the first crankshaft and the first piston connector are both on a first side of the piston and the second crankshaft and the second piston connector are both on a second side of the piston; and wherein the first connecting rod comprises a first set of engaging teeth at or adjacent its second end and the second connecting rod comprises a second set of engaging teeth at or adjacent its second end which interengages with the first set of engaging teeth to inhibit rocking of the piston within the cylinder by balancing asymmetrical forces exerted by the connecting rods.

9. Engine according to claim 1, wherein the first crankshaft is on a first side of the piston and the second crankshaft is on a second side of the piston, the first and second piston connectors being coaxial and intersecting the centreline of the piston.

10. Engine according to claim 1 further comprising a crankcase and a bearing carrier mounted to the crankcase, the bearing carrier being formed of a different material to the crankcase and having a pair of receptacles each receiving a bearing to which one of the pair of crankshafts is mounted.

11. Engine according to claim 10, wherein the bearing carrier comprises a lubricant port associated with each receptacle for introducing a lubricant to the bearings.

12. Engine according to claim 1 comprising a pair of output shafts each having an end coupled to a respective one of the crankshafts.

13. Engine according to claim 1 comprising an inlet valve for introducing air and/or fuel into the cylinder and an exhaust valve for exhausting a gas from the cylinder, wherein the engine is configured such that the inlet valve opens between 15 and 25 degrees before the piston reaches a top dead centre position and closes between 40 and 50 degrees after the piston reaches a bottom dead centre position and the exhaust valve opens between 40 and 50 degrees before the piston reaches the bottom dead centre position and closes between 15 and 25 degrees after the piston reaches the top dead centre position.

14. Engine according to claim 1, wherein the crankshafts are coupled together by a double-sided timing belt.

15. Engine according to claim 1 comprising a first gear mounted for rotation with one of the crankshafts, a second gear mounted for rotation with the other crankshaft and at least one further gear connecting the first and second gears together, thereby synchronising their rotation.

16. Engine according to claim 1, wherein the knuckle housing is received within a cavity of the piston and is pivotally connected thereto by a knuckle housing connector, the piston connectors being on a first side of the knuckle housing connector and the crankshafts being on a second side of the knuckle housing connector, opposite the first side.

17. Engine according to claim 8, comprising:

a crankshaft throw radius described between an axis of rotation of each crankshaft and its crank journal; and an effective crankshaft offset described by the offset between the axis of rotation of each crankshaft and the piston connector to which its connecting rod is connected;

wherein the effective crankshaft offset is between 1.6 and 1.7 times the crankshaft throw radius.

18. Engine according to claim 8 comprising:

a crankshaft throw radius described between an axis of rotation of each crankshaft and its crank journal; and an effective crankshaft offset described by the offset between the axis of rotation of each crankshaft and the piston connector to which its connecting rod is connected;

wherein the effective crankshaft offset is between 1.6 and 1.7 times the crankshaft throw radius.

19. Engine according to claim 8 comprising an inlet valve for introducing air and/or fuel into the cylinder and an exhaust valve for exhausting a gas from the cylinder, wherein the engine is configured such that the inlet valve opens between 15 and 25 degrees before the piston reaches a top dead center position and closes between 40 and 50 degrees after the piston reaches a bottom dead center position and the exhaust valve opens between 40 and 50 degrees before the piston reaches the bottom dead center position and closes between 15 and 25 degrees after the piston reaches the top dead center position.

20. A compression ignition internal combustion engine comprising:

a cylinder;

a piston reciprocably received within the cylinder;

a pair of contra-rotating crankshafts rotatably mounted relative to the cylinder;

a pair of connecting rods each having a first end connected to a crank journal of a respective one of the crankshafts and a second end connected to the piston by a piston connector; and a gimbal or knuckle to which the second end of each connecting rod is pivotally connected, the gimbal or knuckle being pivotally mounted to the piston by a knuckle housing connector such that rotation of the gimbal or knuckle is at least partially independent of the piston rotation;

wherein the piston connectors form a triangulated arrangement with the knuckle housing connector;

wherein the engine is configured such that the piston stroke in a first direction toward the crankshafts causes each crankshaft to rotate by a first angle and the piston stroke in a second direction opposite the first direction causes each crankshaft to rotate by a second angle different from the first angle; and wherein the piston connectors are on a first side of the knuckle housing connector and the crankshafts are on a second side of the knuckle housing connector, opposite the first side, thereby to inhibit rocking of the piston within the cylinder by balancing asymmetrical forces exerted by the connecting rods.

* * * * *